United States Patent [19]

Asawa

[11] Patent Number: 4,784,022

[45] Date of Patent: Nov. 15, 1988

[54] INNER ROTARY CUTTERS FOR ELECTRIC SHAVERS AND MANUFACTURING PROCESSES FOR THE SAME

[75] Inventor: Katsuya Asawa, Matsumoto, Japan

[73] Assignee: Izumi Seimitsu Kogyo Kabushiki Kaisha, Matsumoto, Japan

[21] Appl. No.: 22,163

[22] Filed: Mar. 5, 1987

Related U.S. Application Data

[62] Division of Ser. No. 841,641, Mar. 20, 1986, Pat. No. 4,729,169.

[30] Foreign Application Priority Data

Mar. 29, 1985 [JP] Japan ..... 60-68176
Mar. 29, 1985 [JP] Japan ..... 60-68177

[51] Int. Cl.[4] ..... B21K 21/00
[52] U.S. Cl. ..... 76/101 A
[58] Field of Search ..... 76/101 R, 101 A

[56] References Cited

U.S. PATENT DOCUMENTS 2,494,464 1/1950 Vivie et al. ..... 30/347
4,262,416 4/1981 Van Hemmen et al. .... 30/346.51 X
4,630,370 12/1986 Hamada .

FOREIGN PATENT DOCUMENTS 631383 6/1936 Fed. Rep. of Germany ... 76/101 A

OTHER PUBLICATIONS

Japanese Laying-Open Patent Gazette No. 54-81956, 1954.

*Primary Examiner*—Roscoe V. Parker
*Attorney, Agent, or Firm*—Jordan and Hamburg

[57] ABSTRACT

In an inner rotary cutter for an electric shaver formed by providing a rotary disk at its circumference with a plurality of blade sections at prescribed intervals, a cup-shaped base section is provided which is formed by extending a cylinder section from a circular section in the axial direction to a prescribed length, the base section on its circumference is provided, in one body, with vertically extended sections projecting in the axial direction, each vertically extended section at its tip is provided, in one body, with a horizontally extended section projecting approximately in the radial direction, and the front edge of the horizontally extended section in the direction of rotation is formed into a blade. A ceramic blade may be glued on the end face of the horizontally extended section.

10 Claims, 7 Drawing Sheets

INNER ROTARY CUTTERS FOR ELECTRIC SHAVERS AND MANUFACTURING PROCESSES FOR THE SAME

This is a division of application Ser. No. 841,641, filed Mar. 20, 1986 and now U.S. Pat. No. 4,729,169.

FIELD OF THE INVENTION

This invention relates to inner rotary cutters for electric shavers and manufacturing processes for them.

RELATED ART STATEMENT

An inner rotary cutter for an electric shaver is provided with a plurality of blades disposed at mostly regular intervals on the circumference of a rotatable disk.

The conventional manufacturing process for an inner rotary cutter is illustrated in FIGS. 19–22 and will be described below. FIGS. 19–21 show inner cutter blanks corresponding to various processing steps; in these figures, (A) shows a plan view of the inner cutter blank and (B) shows front view of one blade-forming section. FIG. 22 shows a side view of one blade-forming section.

As the first step, a flat cutter blank 50 shown in FIG. 19 is punched out from a plate material not shown. This cutter blank 50 consists of a circular section 51 and a number of blade-forming sections 52 extending radially from the circumference of the circular section 51.

As the second step, an outer half section 52*a* of the blade-forming section 52 is bent, as shown in FIG. 20(B), with a press to a line R1 slant relative to the radial direction; the angle of bending is close to 90°. Simultaneously with this bending, discharge holes 53 are bored on the circular section 51. Subsequently, a portion of the blade-forming section 52 close to the circular section 51 in FIG. 21(B) is bent, as shown in FIG. 21(B), with a press about 90° in the opposite direction to the bending of the half section 52*a*. The cutter blank is then subject to a heat treatment to a Vickers hardness of ca. 650.

As the third step, the blade-forming section 52 is ground so as to be sliced to a horizontal line R2 shown in FIG. 22 and is polished to form a sharp edge and simultaneously subjected to a plane processing. Thus, a blade section 54 is formed at the tip of the blade-forming section 52 (see FIG. 18).

As the last step, both the outer diameter Do and the inner diameter Di formed by the blade sections 54 (FIG. 18) are made uniform by grinding both the inner side (the central side) 54*a* and the outer side 54*b* of the blade section 54. Thus, an inner cutter 60 is formed.

Most of conventional inner cutters are manufactured as described above and have the form shown in FIG. 18, which is made public, for example, by Japanese Laying-open Patent Gazette No. 54-81956.

Conventional inner cutters have been found to have the following disadvantages:

First, if the so-called progressive press system, usually effective for cost reduction, is used for producing conventional cutters, so much waste material will be produced as to raise the material cost and blade-forming section 52 will catch one another so that the automatic material supply by means of the parts feeder, etc, is disturbed. In addition, when the number of blades is increased and acordingly intervals between blade-forming sections 52 are lessened, the mold should have such thin-thickness sections as to be reduced in service life.

Second, since bending processing with a press needs to be applied at least twice, the spring-back of material will cause irregular positioning of blade sections 54. Also, since complicated bending processing with a press is followed by heat treatment, all the blade sections 54 will experience neither the same thermal strain nor the same strain in the roll direction, so as not to be given the same level of cutting capability.

Third, since the blade sections 54 are involved in positional scatter and the blade-forming sections 52 are involved in height scatter due to the thermal strain, so much material (52*b* in FIG. 22) needs to be ground off in order to make all blade surfaces flush on the same plane. Moreover, since, as seen from the plan view of one blade-forming section 52 shown in FIG. 18, neither the inner diameter Di nor the outer diameter Do of the cutter 60 formed by th blade section 54 in FIG. 18 is exactly circular, an additional grinding processing is required to put all the blade section 54 in order. Note that this grinding processing will consume much time since there exist spaces between blade sections 54 and since each blade section 54 has been made brittle by thermal treatment.

Forth, blade-forming section 52, having been bent with a press, are apt to contain local strains which lower mechanical strength. This results in troubles that the blade-forming sections 52 is easily breakable, etc.

Fifth, as seen from FIG. 18, since the blade section 54 is formed by grinding the end of the half section 52*a* of blade-forming section with a relatively wide area, shaved beards, skin oil, etc. tend to stick on the back of the half section 52*a* in large quantities and cleaning requires much trouble.

Sixth, no ceramic blades may be used which are now regarded as a material for cutting blades which have long service life, high hardness, complete resistance against rusting, etc. This is because many bending processes are applied and because the inner cutter is so complex in shape and so small in size that the manufacture using bending processing is made difficult. In fact, no ceramic blades are being utilized for inner cutters for electric shavers.

OBJECT AND SUMMARY OF THE INVENTION

This invention has resulted from efforts to solve the foregoing disadvantages. The object of this invention is to provide inner rotary cutters for electric shavers which have a number of following advantages.

1. As is evident from a comparison between the blade section of the inner cutter according to this invention shown in FIG. 7 and the blade section (the blade-forming section) of the conventional inner cutter shown in FIG. 18, the blade section of the inner cutter according to this invention is formed on the horizontally extended section which is projected outwards and has a relatively small area at its front portion, and accordingly, shaved beards and skin oil are hard to adhere to the blade section and the horizontally extended section; this makes the cleaning of the inner cutter very easy. Moreover, since the horizontally extended section may be projected further outwards than the vertically extended section and the vertically extended section may be extended outwards stepwise, shaved beards, etc. are allowed to go down the inner cutter for discharge through the blade groove without adhering onto the inner cutter.

2. The cup-shaped base section allows the cylinder section to be positioned outward. Therefore, the weight distribution extends toward outside as compared with the conventional one, with increased force of inertia, which in turn results in preventing temporary loads from changing the number of revolutions. Thus, stable performance may be displaced.

3. Since the vertically extended section is designed to rise from the circumference of the cylinder section positioned outside the base section, the vertically extended section may be made as short as possible and need not be bent near its root as with the conventional structure. This leads to increase in mechanical strength and maintenance of stable performance against temporary load mentioned above.

4. Ceramic blades may be adopted which are an excellent cutteing material. They are endowed with a number of advantages such as high hardness resulting in excellent cutting ability and long service life and no rusting.

Another object of this invention is to provide effective manufacturing processes for above-specified inner cutters which have a number of following advantages.

1. The inner cutter blank is in a simple form of a cup and accordingly, the mold for press is very inexpensive and has a long service life. In addition, automatic material supply is easily made available by means of a parts feeder, etc.

2. The simple form of the inner cutter blank prevents the press work from causing shape distortion or springback, etc. inherent in the conventional process, which allows high-precision processing effective for providing constant cutting ability. Especially, the intersecting angle between the blade section and the outer cutter blade is kept almost constant, in contrast to the conventional press system which causes the intersecting angle to scatter in the angle range 0°–20°.

3. Since the ring plate section is formed by means of a press, the plate surface of the ring plate section which provides the blade face may easily be made flat. This facilitates application of automatic grinding to surface finishing, reduces the ground quantity, and shortens the grinding time. The high dimensional precision provided eliminates after-treatments such as grinding for positional adjustment of all the blade sections, which results in great improvement of grinding steps.

4. The maximum number of blades handle by the conventional press system is about 16, whereas the process according to this invention is capable of handling up to 36 blades by using grinding tools with reduced thickness.

5. According to the manufacturing process of this invention, a ceramic plate is first glued on a metal surface and then subjected to grinding. Therefore, even a ceramic blade which is too brittle to be subjected to grinding as it is, may be processed easily without getting broken.

DETAILED DESCRIPTION OF PREFERRED EMBODIMENTS

Suitable embodiments of this invention will be described in detail by reference to the accompanying drawings.

THE FIRST EMBODIMENT

To assist in the understanding of the structure of an inner cutter 1 in relation to this embodiment, the manufacturing process will be described by reference to FIGS. 3–6 for various processing steps. FIGS. (A) and (B) refer to an inner cutter blank at each processing step, FIG. (A) showing a front view with a partly cross section and FIG. (B) a bottom view.

(Punch step)

Figure 3A:
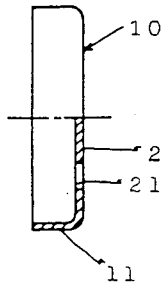
FIGS. 3–6 show states of an inner cutter blank at various processing steps for manufacturing an inner cutter for an electric shaver according to this invention, where FIG. (A) shows a front view with a partly cross section and FIG. (B) shows a bottom view.
Figure 3B:
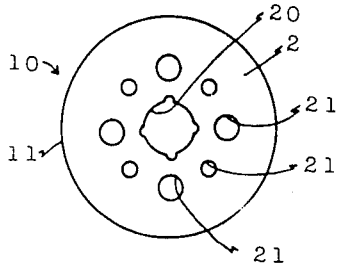

In this step, a cup-shaped inner cutter blank 10 shown in FIG. 3 is punched out from a plate material not shown. The inner cutter blank 10 consists of a circular section 2 and a cylinder section 11 extending from the circumference of this circular section 2 in the axial direction to a prescribed length. In this punch step, punch is also made for an attaching hole 20 positioned at the center of the cutter section 2 and discharge holes 21 disposed around the center.

(Drawing step)

Figure 4A:
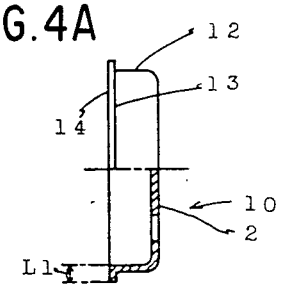
Figure 4B:
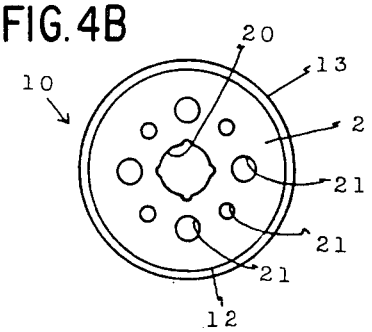

As shown in FIG. 4, the cylinder section 11 of the above-described blank 10 is drawn to form a small cylinder section 12 with reduced diameter and at the same time to form a flange-shaped ring plate section 13 bent outwards in the radial direction on the circumferential of the open-mouthed end. The width L1 of the ring plate section 13 becomes equal to the width of a blade section 7. Accordingly, the width of the blade section 7 may be changed with the diameter of the cylinder section 11 to be reduced by the press drawing.

(The second drawing step)

Figure 5A:
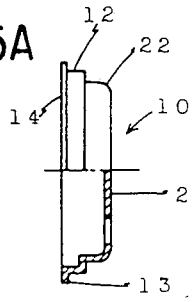
Figure 5B:
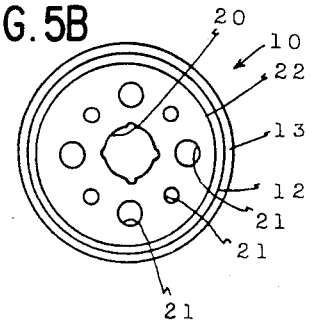

The small cylinder section 12, having been drawn in the foregoing drawing step, is subjected, as shown in FIG. 5, to a further drawing on the portion from a prescribed intermediate position toward the side of the circular section 2 to form the second small cylinder section 22. Note that this second drawing step may be omitted, i.e., that the second small cylinder section 22 need not be provided; the provision of this cylinder section 22 helps shaved beards go downwards for discharge smoothly.

(Heat treatment step)

A heat treatment (hardening) is applied to harden the inner cutter blank 10. The hardness is brought to a Vickers hardness of ca. 650.

(Grinding step)

The inner cutter blank 10 through the heat treatment has the plate surface 14 of the ring plate section 13 ground and polished. After this treatment the plate surface 14 has been through a plane finish treatment to be completely flat.

(Blade cutting step)

Figure 6A:
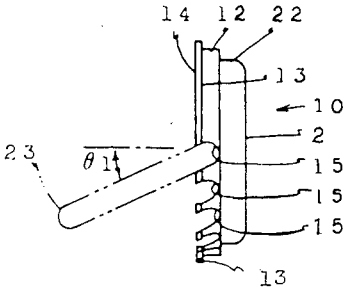
Figure 6B:
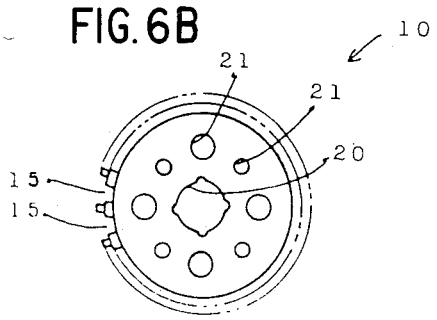

As shown in FIG. 6, the inner cutter blank 10 through the foregoing grinding is ground with a grinding tool 23, such as a rotary grinding or a cutter, in the form of a disk with rounded circumference to form place grooves 15. This blade groove 15 is in the form of a cut ranging from the ring plate section 13 to the boundary between the small cylinder section 12 and the second small cylinder section 22. Note that, though it is optimal for the cut to have such a depth, other depths, such as reaches the circular section 2, may be adopted. The blade groove 15 (the grinding tool 23) should be inclined by a prescribed angle in the rotational direction of the inner cutter; the angle of inclination $\theta 1$ is optimally 25°–35° as shown in FIG. 6. In addition, the blade groove 15 (the grinding tool 23) should slightly be inclined relative to the radial direction; the angle of inclination $\theta 2$, making an intersecting angle relative to the outer cutter as shown in FIG. 1, is optimally about 12°.

Figure 1:
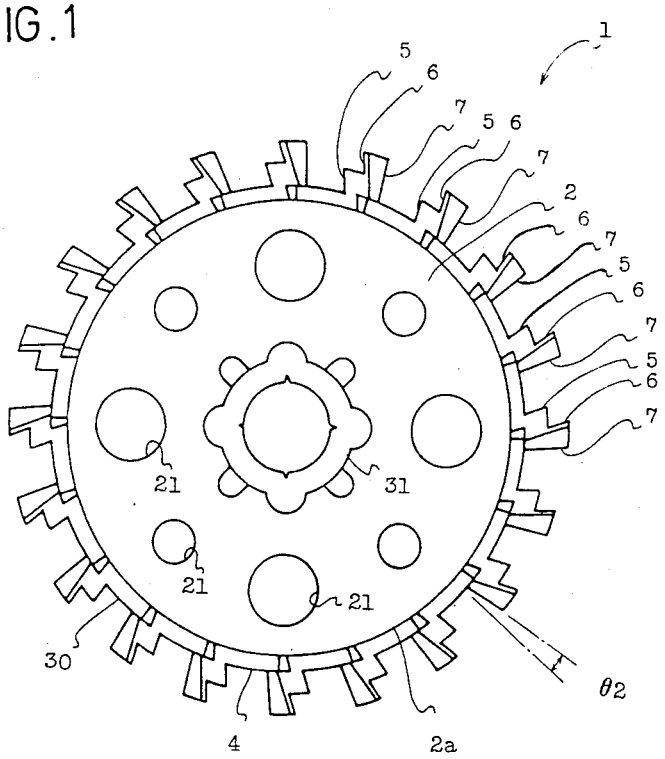
FIG. 1 shows a plan view of an inner cutter for an electric shaver according to this invention.
Figure 2:
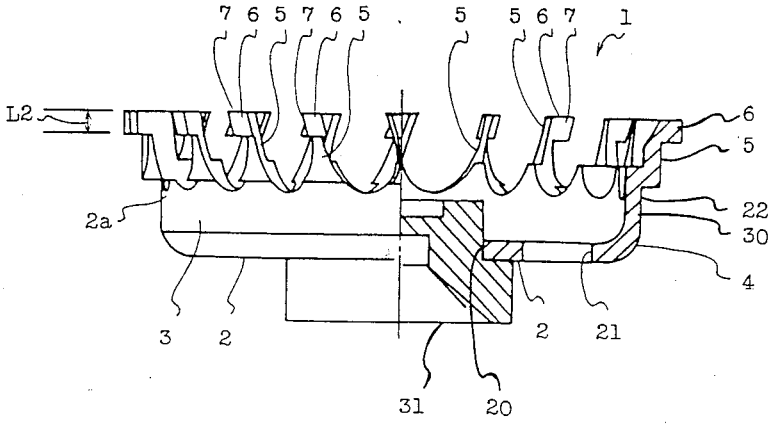
FIG. 2 shows a front view with a partly cross section of the inner cutter of FIG. 1.

The inner cutter 1 shown in FIGS. 1 and 2 is completed when a catching member 31 to engage with a driving pole not shown is press attached to the attaching hole 20 of the inner cutter proper 30 having been prepared by the foregoing steps.

The inner cutter 1 of this embodiment manufactured by the foregoing process will now be described by reference to FIGS. 1, 2, and 7. FIG. 1 shows a plan view of the inner surface for an electric shaver for this embodiment, FIG. 2 shows a front view with a partly cross section of the inner cutter of FIG. 1, and FIG. 7 shows a plan view of one blade section of the inner cutter of FIG. 1.

The inner cutter 1 is composed, in one body, of the circular section 2, the cup-shaped base section 4 having the cylinder section 3 extended from the circumference 2*a* of the circular section 2 in the axial direction to a predescribed length, and a plurality of the vertically extended sections 5 projecting from the circumference of the base section 4 in the axial direction. These vertically extended sections 5 are extended from near the end of the second small cylinder section 22 at an angle relative to the direction of rotation, and each vertically extended section 5 is in the form of a projection with its tip side narrowed and at the same time is extended outwards stepwise.

Each vertically extended section 5 is provided, in one body, with a horizontally extended section 6 projecting outwards in the radial direction and each horizontally extended section 6 is provided with the blade section 7 at its front edge in the direction of rotation.

Figure 7:
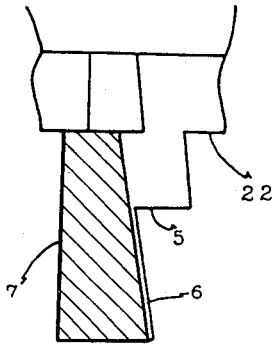
FIG. 7 shows a plan view of one blade section of the inner cutter in relation to FIGS. 3–6.

The horizontally extended section 6 is in the form of an approximate parallelogram in its longitudinally vertical cross-section as shown in FIG. 2, and in the form of an approximately trapezoid in its horizontal shape as shown in FIG. 7. The outside width L2 of the horizontally extended section 6 thus formed is roughly equal to the thickness of the plate material used.

The embodiment has been described in detail. This invention is of course not restricted to this embodiment. Thus, the second drawing step may be omitted, a similar third drawing step may be added, or the magnitude of $\theta 1$, $\theta 2$, L1 or L2 may be selected arbitrarily.

THE SECOND EMBODIMENT

A suitable manufacturing process for obtaining an inner cutter in relation to the second embodiment will be described by reference to FIGS. 10–15 for various processing steps. FIGS. 10–12, 14, and 15 refer to an inner cutter blank at each processing step and FIG. 13 shows a ceramic plate, FIG. (A) showing a front view with a partly cross section and FIG. (B) a bottom view.

(Punch step)

Figure 10A:
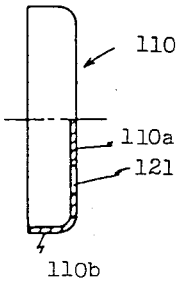
FIGS. 10–12, 14, and 15 show states of an inner cutter blank at various processing steps for manufacturing an inner cutter for an electric shaver in relation to the embodiment of FIG. 8.
Figure 10B:
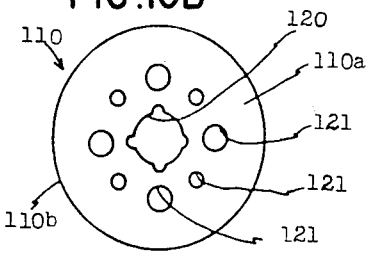

In this step, A cup-shaped inner cutter blank 110 shown in FIG. 10 is punched out from a plate material not shown. The inner cutter blank 110 consists of a circular section 110*a* and cylinder section 110*b* extending from the circumference of this circular section 110*a* in the axial direction to a prescribed length. In this punch step, punch is also made for an attaching hole 120 positioned at the center of the circular section 110*a* and discharge holes 121 disposed around the center.

(Drawing step)

Figure 11A:
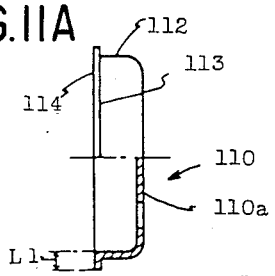
Figure 11B:
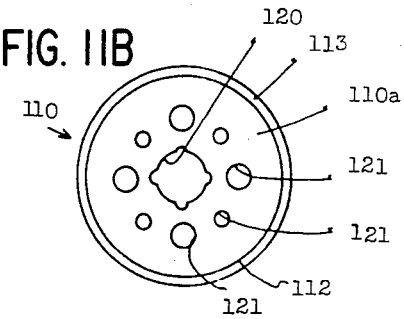

As shown in FIG. 11, the cylinder section 110*b* of the above-described blank 110 is drawn to form a small cylinder section 112 with reduced diameter and at the same time to form a flange-shaped ring plate section 113 bent outwards in the radial direction around the circumference of the open-mouthed end. The width L1 of the ring plate section 113 becomes equal to the width of a blade section 105. Accordingly, the width of the blade section 105 may be changed with the diameter of the cylinder section 110*b* to be reduced by press drawing.

(The second drawing step)

Figure 12A:
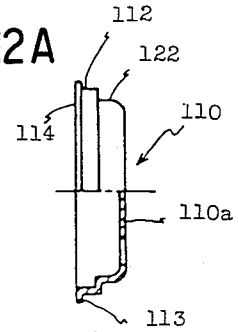
Figure 12B:
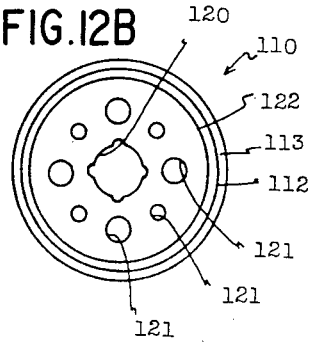
Figure 13A:
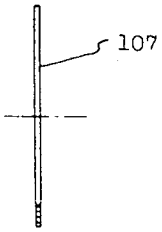
FIG. 13 shows a ceramic plate, where FIG. (A) shows a front view with a partly cross section and FIG. (B) shows a bottom view.
Figure 13B:
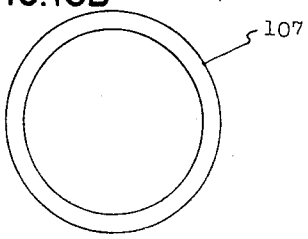
Figure 14A:
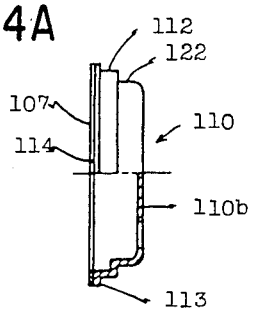
Figure 14B:
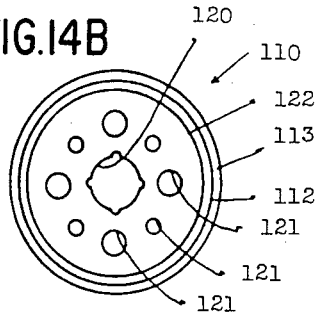

The small cylinder section 112, having been drawn in the foregoing drawing step, is subjected, as shown in FIG. 12, to a further drawing on the portion from a prescribed intermediate position toward the side of the circular section 110*a* to form the second small cylinder section 122. Note that the second drawing step may be omitted, i.e., that the second small cylinder section 122 need not be provided;, the provision of this cylinder section 122 helps shaved beards go downwards for discharge smoothely.

(Ceramic-plate gluing step)

A ring-shaped ceramic plate 107 shown in FIG. 13 is prepared at hand. This ceramic plate 107 is ca. 0.2 mm thick and the outer and inner diameters of the ring are equal, respectively to the outer and inner diameters of the ring plate 113.

The ceramic plate 107 is glued with adhesive onto the plate surface 114 of the ring plate 113.

(Blade cutting step)

Figure 15A:
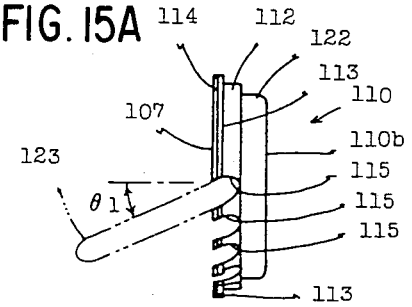
Figure 15B:
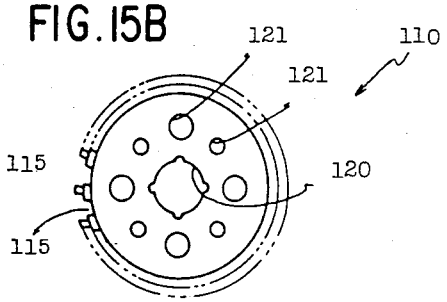

As shown in FIG. 15, the inner cutter blank 110 through the foregoing grinding is ground with a grinder tool 123, such as a rotary grinder (e.g., a diamond grinder), in the form of a disk with a rounded circumference to form blade grooves 115. This blade groove 115 is in the form of a cut ranging from the plate surface of the ceramic plate 107 via the ring plate section 113 to the boundary between the small cylinder section 112 and the second small section 122. The blade groove 115

(the grinding tool 123) should be inclined by a prescribed angle of the rotational direction of the inner cutter; the angle of inclination $\theta 1$ is optimally 25°–35° as shown in FIG. 13. In addition, the blade groove 115 (the grinding tool 123) should slightly be inclined relative to the radial direction; the angle of inclination $\theta 2$, making an intersecting angle relative to the outer cutter as shown in FIG. 8, is optically about 12°.

Figure 8:
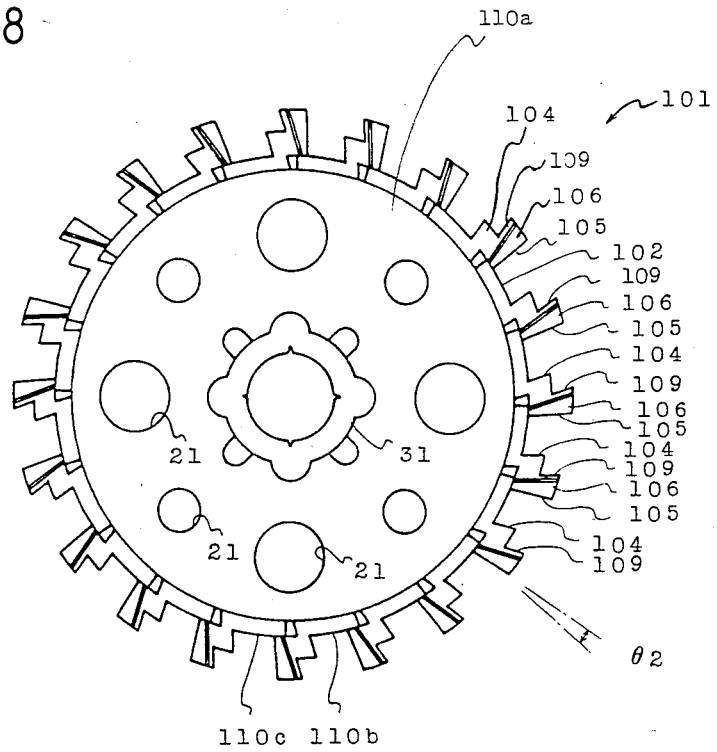
FIG. 8 shows a plan view of an inner cutter for an electric shaver to illustrate another embodiment of this invention.
Figure 9:
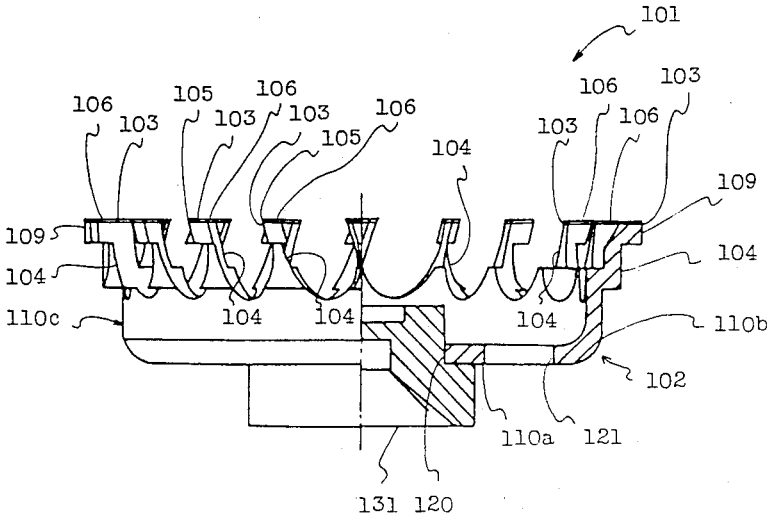
FIG. 9 shows a front view with a partly cross section of the inner cutter of FIG. 8.

The inner cutter 101 shown in FIGS. 8 and 9 is completed when a catching member 131 to engage with a driving pole not shown is press attached to the attaching hole 120 of the inner cutter proper 130 having been prepared by the foregoing steps.

The inner cutter 101 manufactured by the foregoing process will now be described by reference to FIGS. 8, 9, 16, and 17. FIG. 8 shows a plan view of the inner cutter for an electric shaver for this embodiment, FIG. 9 shows a front view with a partly cross section of the inner cutter of FIG. 8, FIG. 16 shows a plan view of one blade section of the inner cutter of FIG. 8, and FIG. 17 shows a front view of the blade section of FIG. 16.

The inner cutter 101 is composed, in one body, of the circular section 110*a*, the cup-shaped base section 110*c* having the cylinder section 110*b* extended from the circumference of the circular section 110*a* in the axial direction to the prescribed length, and a plurality of the vertically extended section 104 projection from the circumference of the base section 110*c* in the axial direction. These vertically extended sections 104 are extended from near the end of the second small cylinder section 122 at an angle relative to the direction of rotation, and each vertically extended section 104 is in the form of a projection with its tip side narrowed and at the same time is extended outwards stepwise.

Each vertically extended section 104 is provided, in one body, with a horizontally extended section 109 projecting outwards in the radial direction. Each horizontally extended section 109 has a ceramic blade 106 glued on its top surface. Each ceramic blade 106 is provided with the blade section 105 at its front edge in the direction of rotation.

Figure 16:
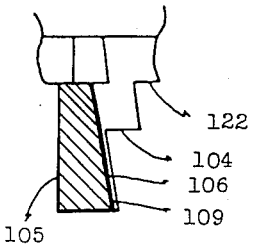
FIG. 16 shows a plan view of one blade section of the inner cutter in relation to FIGS. 10–15.
Figure 17:
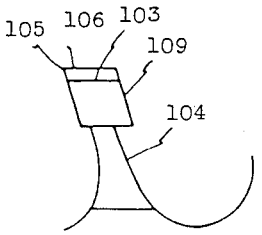
FIG. 17 shows a front view of the blade section of FIG. 16.
Figure 18:
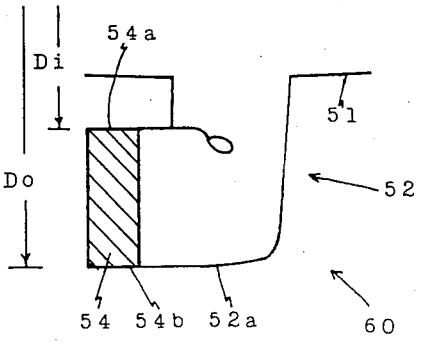
FIG. 18 PRIOR ART
FIG. 18 shows a plan view of one blade section in a conventional inner cutter for an electric shaver.
Figure 19A:
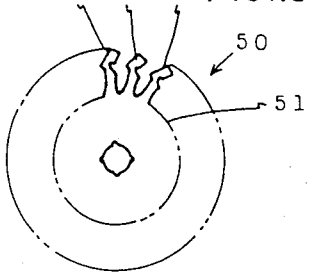
FIG. 19A PRIOR ART
FIGS. 19–21 show states of an inner cutter blank at various processing steps for manufacturing an inner cutter for an electric shaver according to conventional manufacturing process, where FIG. (A) shows a plan view of the inner cutter blank and FIG. (B) shows a front view of one blade-forming section.
Figure 19B:
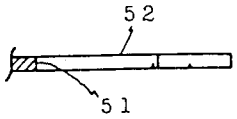
FIG. 19B PRIOR ART
Figure 20A:
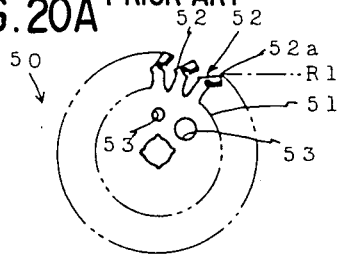
FIG. 20A PRIOR ART
Figure 20B:
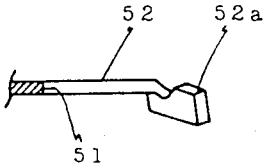
FIG. 20B PRIOR ART
Figure 21A:
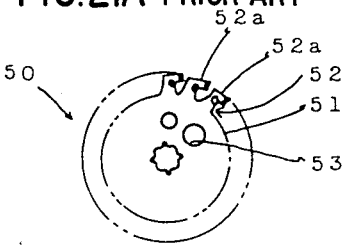
FIG. 21A PRIOR ART
Figure 21B:
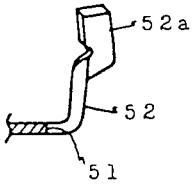
FIG. 21B PRIOR ART
Figure 22:
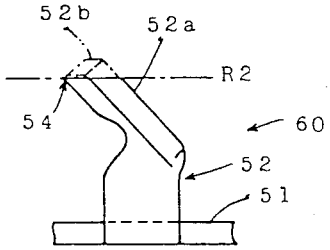
FIG. 22 PRIOR ART
FIG. 22 shows a side view of one blade-forming section of the inner cutter blank in relation to FIGS. 19–21.

The set of a horizontally extended section 109 and a ceramic blade 106 is in the form of an approximate parallelogram in its longitudinally vertical cross-section as shown in FIGS. 9 and 17, and in the form of an approximate trapezoid in its horizontal shape as shown in FIG. 16.

The embodiment has been described in detail. This invention is of course not restricted to this embodiment. Thus, the second drawing step may be omitted, a similar third drawing step may be added, or the magnitude of $\theta 1$, $\theta 2$, or L1 may be selected arbitrarily.

Moreover, this invention may be embodied by separatly preparing ceramic blade 106 shown in FIG. 17 and glueing each ceramic blade 106 on the flat end face 103 of each vertically extended section 104.

What is claimed is:

1. A manufacturing process for an inner rotary cutter for an electric shaver, comprising the following steps:

(a) punching out from a plate material a cup-shaped inner cutter blank, having a cylinder section extending from the circumference of a circular section to a prescribed length in the axial direction;

(b) drawing said cylinder section to form a small cylinder section with reduced diameter and having an open-mouthed end and pressing the open-mouthed end of said cylinder section to form a ring plate section bent outward in the radial direction and having a flat face;

(c) grinding and polishing the flat face of said ring plate section; and (d) cutting blades by applying a grinding tool on said ring plate section and said small cylinder section to form blade grooves, inclined relative to the direction of rotation, at prescribed intervals.

2. A manufacturing process for an inner rotary cutter for an electric shaver according to claim 1, further comprising after said drawing step, heat treating and thereby hardening said inner cutter blank.

3. A manufacturing process for an inner rotary cutter for an electric shaver according to claim 1, further comprising in said punching step also punching out discharge holes in said circular section.

4. A manufacturing process for an inner rotary cutter for an electric shaver according to claim 1, further comprising in said drawing step forming a plurality of said small cylinder sections in a stepped form.

5. A manufacturing process for an inner rotary cutter for an electric shaver according to claim 1, further comprising in said blade cutting step forming blade grooves inclined both in the direction of rotation and in the radial direction.

6. A manufacturing process for an inner rotary cutter for an electric shaver comprising the following steps:

(a) punching out from a plate material a cup-shaped inner cutter blank, having a cylinder section extending from the circumference of a circular section to a prescribed length in the axial direction;

(b) drawing said cylinder section to form a small cylinder section with reduced diameter and having an open-mouthed end and pressing the open-mouthed end of said cylinder section to form a ring plate section bent outward in the radial direction and having a flat face;

(c) gluing a ceramic plate on the flat face of said ring plate section; and (d) cutting blades by applying a grinding tool on said ring plate section and said small cylinder section to form blade grooves, inclined relative to the direction of rotation, at prescribed intervals.

7. A manufacturing process for an inner rotary cutter for an electric shaver according to claim 6, further comprising after said drawing step heat treating and thereby hardening said inner cutter blank.

8. A manufacturing process for an inner rotary cutter for an electric shaver according to claim 6, further comprising in said punching step also punching out discharge holes in said circular section.

9. A manufacturing process for an inner rotary cutter for an electric shaver according to claim 6, further comprising in said drawing step forming a plurality of said small cylinder sections in a stepped form.

10. A manufacturing process for an inner rotary cutter for an electric shaver according to claim 6, further comprising in said blade cutting step forming blade grooves inclined both in the direction of rotation and in the radial direction.

* * * * *